United States Patent [19]

Bell et al.

[11] Patent Number: 4,721,426

[45] Date of Patent: Jan. 26, 1988

[54] BRIDGE PLATE

[75] Inventors: Edward A. Bell; Roger D. Sims, both of Munster, Ind.

[73] Assignee: Stanrail Corporation, Hammond, Ind.

[21] Appl. No.: 892,033

[22] Filed: Aug. 1, 1986

[51] Int. Cl.[4] ..... B61D 49/00; B65G 67/00

[52] U.S. Cl. ..... 414/340; 14/71.1; 105/458

[58] Field of Search ..... 414/340, 345, 346; 410/1, 6, 26, 27, 29.1; 105/436, 458; 14/69.5, 71.1

[56] References Cited

U.S. PATENT DOCUMENTS

| | | | |
|---|---|---|---|
| 2,127,480 | 8/1938 | Fitch | 414/345 |
| 2,996,020 | 8/1961 | Udstad | 410/6 X |
| 3,195,478 | 7/1965 | Thompson | 105/436 X |
| 3,203,364 | 8/1965 | Gutridge | 105/458 |
| 3,351,024 | 11/1967 | Broling | 105/458 |
| 3,572,254 | 3/1971 | Slager | 14/71.1 X |
| 4,119,042 | 10/1978 | Naves et al. | 410/27 |
| 4,634,145 | 1/1987 | Humpe | 14/69.5 X |

*Primary Examiner*—Nancy J. Stodola

*Attorney, Agent, or Firm*—Kinzer, Plyer, Dorn, McEachran & Jambor

[57] ABSTRACT

Bridge plate for moving automobiles between railroad auto-rack cars characterized by an intermediate upright trues and two bracing trusses joined thereto of inverted trapezoidal cross section. A bottom plate joins the bracing trusses, secured by mechanical fasteners, and struts are interposed between the bottom plate and the intermediate truss to transfer a load on the intermediate truss to the bottom plate. The intermediate truss presents a flat top for one set (left or right) of the automobile wheels.

2 Claims, 6 Drawing Figures

BRIDGE PLATE

This invention relates to bridge plates employed as a ramp to support an automotive vehicle being moved from one auto-rack railroad car to another, bridging the space between.

Bridge plates of the foregoing kind are known, being pivotally attached to the auto-rack car in position to be lowered manually when a loading or unloading procedure is to take place. However, the plates have been extremely heavy in the past. This circumstance of the heavy plate which must be raised and lowered manually creates an industrial hazard; workmen have complained of the weight and the potential hazard. We address this problem and we also address the problem of constructing a lightweight bridge plate which will meet AAR standards.

One object of the present invention is to construct a lightweight plate of minimum thickness, not to exceed thirty pounds in weight, so that very little strain will be encountered on the part of workmen raising and lowering the plate.

Another object of the invention is to construct a bridge plate meeting the AAR (Association of American Railroads) standard of being able to support a 4500 pound static load (with limited permanent set) and a 1500 pound dynamic load of 30,000 cycles at the center and 20,000 cycles near each end without failing.

IN THE DRAWING

Figure 1:
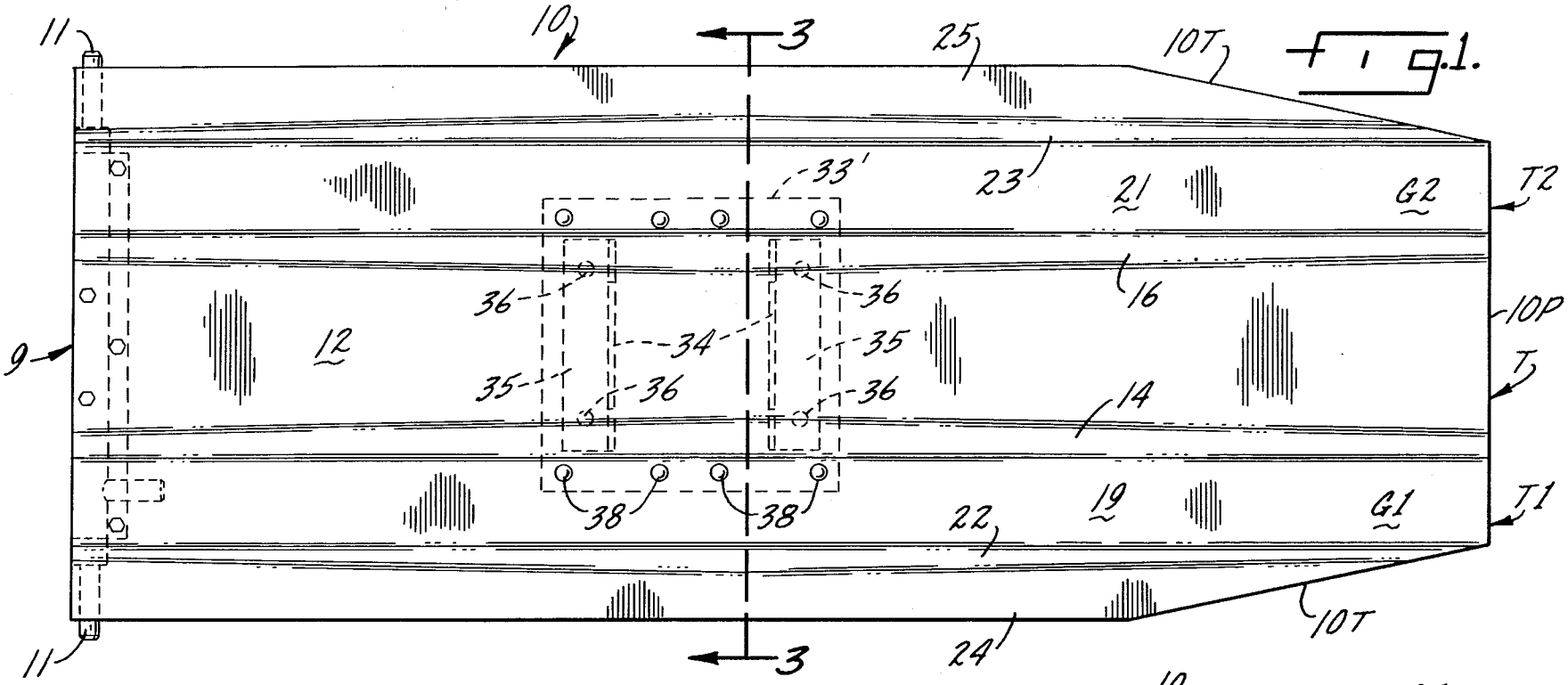
FIG. 1 is a top plan view of a bridge plate constructed in accordance with the present invention.

The large one-piece plate 9 for the bridge plate 10, FIG. 1, is entirely of aluminum and because of the unique features described in detail hereinafter, the plate need only be 5/32" thick.

The plate is elongated in nature and one end includes a known hinge structure including a pair of spring-biased hinge pins 11 which are employed to hinge the plate to the unloading end of an auto-rack (railroad) car in a known manner. These pins may be steel, aluminum, or some other metal. The hinge structure and its mode of attachment to the plate constitute no part of the present invention.

The opposite end of the bridge plate is tapered at 10T to a narrowed platform portion 10P which will rest on the end of another car and thus bridge the space between the two cars.

The thickness dimension is important. With aluminum, reducing the thickness by as little as 1/64" saves two pounds overall weight when the plate is 53" long, with a span of 21.5" at the wide end and 15.5" at the narrow end. These are the dimensions of the plate 9.

Figure 3:
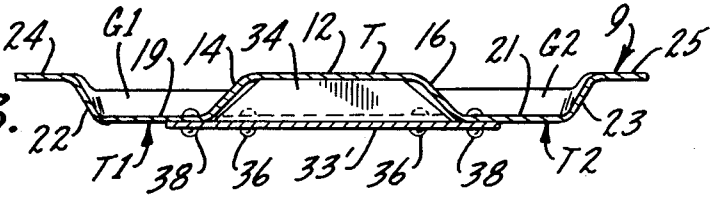
FIG. 3 is a sectional view on line 3—3 of FIG. 1.

Referring to FIG. 3, the cross section of the plate between the hinged end and the tapered dock end includes several trusses partly responsible for being able to construct the plate entirely of aluminum and of minimum thickness at that.

The large aluminum plate 9 in cross section includes a longitudinally extending, medially located truss T. This medially located truss has a top land 12 which constitutes a supporting surface for one set of car wheels, left set or right set. Thus it can be readily seen that two bridge plate assemblies as 10 are employed in the automobile unloading procedure. One plate will support the set of left wheels and the other plate will support the set of right wheels.

The central truss T is itself braced by two side trusses T1 and T2 which in effect define grooves or channels G1 and G2, FIG. 1, extending the length of the plate.

The trusses thus defined have, in common, inner bracing struts or webs 14,16 which slope downwardly and outwardly compared to the tread supporting surface 12. The trusses T1 and T2 have depressed flats 19 and 21, respectively. The flats 19 and 21 at their inner edges are joined to the braces 14 and 16 and at their outer edges are joined to outwardly and upwardly inclined bracing struts or webs 22 and 23, respectively.

The outermost braces 22 and 23 merge into the flat, lateral side surfaces 24 and 25 of the bridge plate. Thus, the two bracing trusses T1 and T2 extend longitudinally between and are connected to the lateral flat sides, 24 and 25, and the intermediate truss T.

It can be readily visualized from FIG. 3 that the central truss T is of trapezoidal configuration, deemed an upright regular trapezoid, and merges into the two side trusses which are also a trapezoidal configuration but deemed inverted regular trapezoids. The centrally located bracing struts 14 and 16 of the medial truss T constitute sides which are, respectively, common with the associated side trusses.

The plate is additionally strengthened by tapering in plan view, FIG. 1, the truss braces 14, 16, 22 and 23. Thus, as shown in FIG. 1, the sloped truss sides 14, 16, 22 and 23 are in the form of adjacent pairs of identical triangles, each having a common altitude A at the center of the plate and tapering uniformly toward the opposed ends of the plate.

Figure 2:
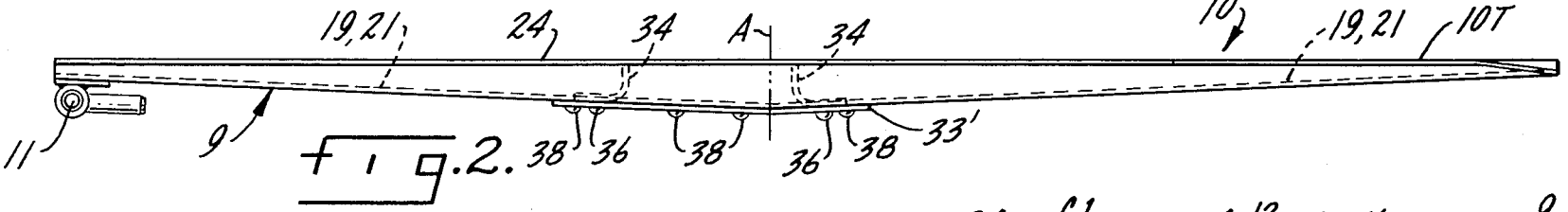
FIG. 2 is a side elevation of FIG. 1.

Thus, an additional strengthening factor, and a savings in weight, are achieved by having the truss troughs or grooves 19 and 21, FIG. 2, sloping downwardly from a shallow depth adjacent each of the outer ends of the plate to a deeper depth at the medial portion.

Figure 4:
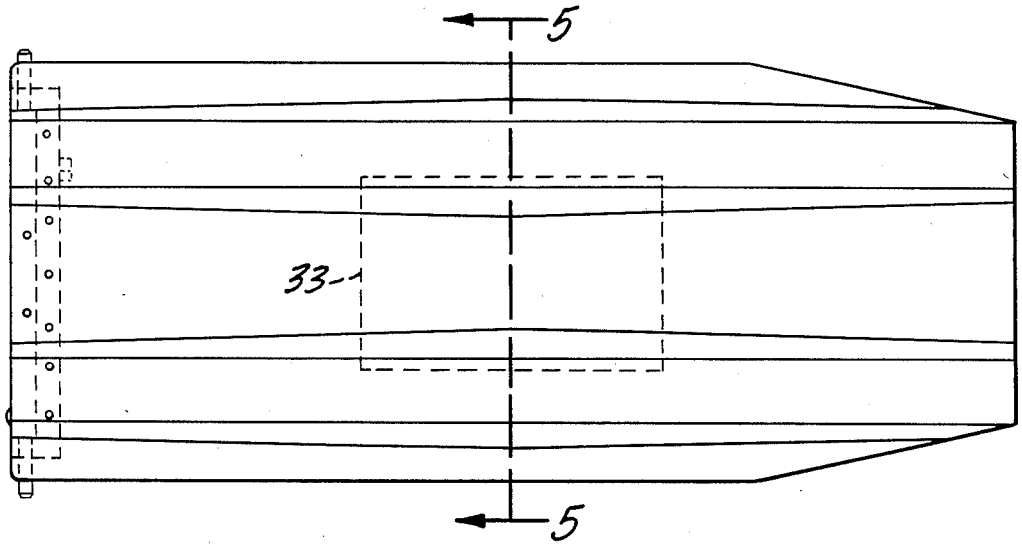
Fig. 4. (PRIOR ART)
FIG. 4 is a view similar to FIG. 1, showing prior art.
Figure 5:
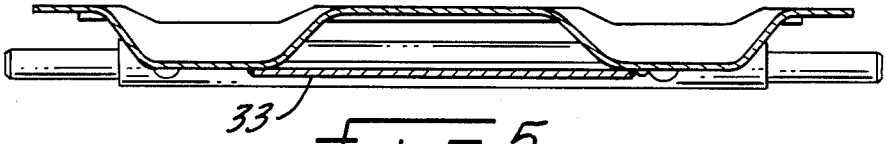
Fig. 5. (PRIOR ART)
FIG. 5 is a sectional view on line 5—5 of FIG. 4.

The foregoing is also descriptive of the prior art we were faced with, FIGS. 4 and 5, which further included a bottom rectangular brace plate 33 which was welded at its side edges to the underside of the two trusses T1 and T2. Theoretically, a brace plate as 33 should permit a reduction of 1/64" in the thickness of plate 9. The brace plate should also maintain a flat dimensional integrity for the tread surface 12. This construction, FIGS. 4 and 5, was expected to become commercial but it failed the AAR test. The plate 33 developed a dome, buckling upward in the direction of the central truss T and the ends of the tread surface 12 dished downwardly at the same time. The welds exhibited evidence of failing.

Figure 6:
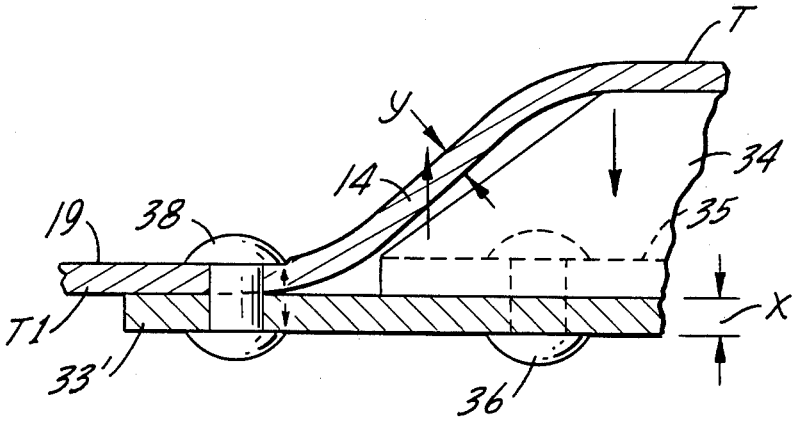
FIG. 6 Is an enlarged partial sectional view.

We determined, by force analysis, that the vehicle load was subjecting plate 33 to compression loading and that a weld was therefore totally unacceptable. To solve the problem, we reduced the dimension of plate 33 on all sides from 13"×16" to 11.5"×11.5×, allowing us to employ a plate 33' having a thickness of ¼", less likely to buckle. That is, the thickness of plate 33' should be 1.5 to 1.8 times the thickness (5/32") of plate 9. This is shown in FIG. 6 where thickness "X" is ¼" and thickness "y" is 5/32". This slight increase makes the plate 33' two to four times stiffer than the tread thickness (e.g. 5/32") at T.

But more importantly, we introduced a pair of upright webs or gussets 34, with integral flanged bases 35, positioned between plate 33' and the underside of the central truss T. These webs transmit loading on the lands 12 to the plate 33. Mechanical fasteners, either aluminum bolts, or aluminum rivets 36 as shown, FIG. 3, join the flanges 35 to the reinforcing plate 33'.

The ends of plate 33' are secured to the underside of the trusses T1 and T2 by aluminum rivets 3S; but again, bolts would be equivalent.

Plate 33' has no underpinning or beam support. However, it will be noted in FIG. 3 that the sloped sides of the webs 34 are spaced inward of the adjacent inside surfaces of the braces 14 and 16, assuring that beam loading on the vertical webs 34 is transmitted directly to plate 33'. This prevents plate 33' from buckling and at the same time the rivets 38 transfer stress of vertical loading on plate 33' to the bottom flanges 19 and 21 of the side trusses T1 and T2. This force is absorbed by the large heads of rivets 38 which have great mechanical integrity. At the same time, the downward beam forces present in the braces 14 and 16 are applied merely as shearing force components to the shanks of the fasteners 38, serving as strong cleats. In FIG. 6, the forces are shown by arrows. By this arrangement there are no welds susceptible to failure due to prying forces as in the instance of the prior art.

The sides of the trusses are shown as sloped at an angle which is considerable since such angling makes manufacturing easier. In principle the angle may nearly be eliminated so that the channels represented by the trusses may be nearly rectangular or boxlike (U-shaped) which would also add more strength. Therefore, the truss angle is not critical and may be considerably altered from what is shown so that the sides 14,16 and 22,23 may be approximately upright, as long as they do not buckle under the load. The outer sides 24,25 may be bent downward if desired.

The webs 34 may be rectangular rather than trapezoidal and may be secured in position by welds rather than rivets. A slight space may be allowed initially between the upper edges of the webs 34 and the lower surface of the flat 12 since the load of the vehicles will produce some downward flexing of the flats or lands 12. Instead of providing each web 34 with a horizontal flange 35 fastened to plate 33', the sides of the webs may be flanged and fastened to the truss sides 14 and 16 by rivets or welds.

We claim:

1. A bridge plate for moving vehicles between railroad auto-rack cars and comprising an elongated aluminum plate to be paired with a like plate for receiving respectively, the left and right sets of wheels of the vehicle, said plate having in cross section:

outer sides extending the length of the plate; an intermediate upright truss (T) extending lontudinally between the ends of the bridge plate; said intermediate truss including a top land (12) joined to downwardly extending side webs (14,16) with the land constituting the surface on which one set of wheels will ride;

two inverted bracing trusses (T1,T2) respectively positioned between and connecting the intermediate truss and said outer sides;

said bracing trusses each having one side respectively (14,16) in common with the intermediate truss, each having a flat bottom flange (19,21), and each having an upwardly extending web (22,23) joined, respectively, to said outer sides;

a reinforcing plate (33') positioned beneath the intermediate truss and joined by rivets, each having a shank and a pair of heads, to the underside of said flats (19,21);

and vertical webs (34) positioned between the reinforcing plate and the underside of the intermediate truss for transferring a load on the top land (12) to the reinforcing plate; said vertical webs having slope sides generally parallel to but spaced inward of the opposed surfaces of the bracing trusses, whereby beam loading on the webs (34) is transmitted directly to the reinforcing plate (33') so it will not buckle while the rivet heads in turn transfer loading on plate (33') to the bottom flanges (19,21), and whereby additionally beam loading on the side webs (14,16) is applied as shearing forces to the shanks of the rivets.

2. The bridge plate of claim 1 in which the sides of the bracing trusses (14,16; 22,23) are triangle-shaped presenting substantially identical triangles having a common altitude (A).

* * * * *